US010716388B2

(12) United States Patent
Pellenc et al.

(10) Patent No.: US 10,716,388 B2
(45) Date of Patent: Jul. 21, 2020

(54) CARRY HARNESS WITH CHEST FASTENER

(71) Applicant: PELLENC, Pertuis (FR)

(72) Inventors: Roger Pellenc, Pertuis (FR); Pauline Philibert, La Tour d'Aigues (FR)

(73) Assignee: PELLENC, Pertuis (FR)

( * ) Notice: Subject to any disclaimer, the term of this patent is extended or adjusted under 35 U.S.C. 154(b) by 0 days.

(21) Appl. No.: 16/320,205

(22) PCT Filed: Aug. 28, 2017

(86) PCT No.: PCT/FR2017/052288

§ 371 (c)(1),
(2) Date: Mar. 13, 2019

(87) PCT Pub. No.: WO2018/050979

PCT Pub. Date: Mar. 22, 2018

(65) Prior Publication Data

US 2019/0269226 A1 Sep. 5, 2019

(30) Foreign Application Priority Data

Sep. 13, 2016 (FR) ..... 16 58490

(51) Int. Cl.
*A45F 3/14* (2006.01)
*A45F 5/00* (2006.01)

(52) U.S. Cl.
CPC ..... *A45F 3/14* (2013.01); *A45F 5/00* (2013.01); *A45F 2003/144* (2013.01); *A45F 2003/146* (2013.01); *A45F 2200/0575* (2013.01)

(58) Field of Classification Search
CPC ..... A45F 2003/146; A45F 3/14; A45F 2200/0575; A45F 3/047; A01D 34/902; Y10T 24/45084
See application file for complete search history.

(56) References Cited

U.S. PATENT DOCUMENTS 2,416,757 A * 3/1947 Johnston ..... B64D 17/32 24/579.11
6,247,624 B1 * 6/2001 Rundberg ..... F16M 13/04 224/220

(Continued)

FOREIGN PATENT DOCUMENTS

EP 0650677 A2 5/1995
EP 1205123 A2 5/2002

(Continued)

OTHER PUBLICATIONS

International Search Report for PCT/FR2017/052288.

*Primary Examiner* — Adam J Waggenspack

(74) *Attorney, Agent, or Firm* — Egbert Law Offices, PLLC

(57) ABSTRACT

A carry harness includes: two carry straps, two chest straps connected respectively to the carry straps, a chest fastener configured for joining together the chest straps, the fastener extending along an attachment plane, and at least one tool-carrying strap. The chest straps and the tool-carrying strap are connected to the chest fastener with freedom to pivot in the plane of attachment about at least one axis of pivoting passing through the chest fastener and perpendicular to the attachment plane. The chest fastener has a first part and a second part, which parts are non-pivoting and removable one from the other, the first part and the second part being connected respectively to the chest straps. Application to the carrying of tools and batteries of accumulator cells.

7 Claims, 3 Drawing Sheets

(56) References Cited

U.S. PATENT DOCUMENTS

| | | | | |
|---|---|---|---|---|
| 6,687,963 | B1 * | 2/2004 | Chang | A44B 11/2584 24/265 BC |
| 7,657,978 | B2 * | 2/2010 | Lin | A01K 27/005 24/614 |
| 8,813,320 | B2 * | 8/2014 | Zhao | A44B 11/2519 24/579.11 |
| 8,910,840 | B2 * | 12/2014 | Kamo | A45F 3/14 224/268 |
| 8,925,774 | B2 * | 1/2015 | Mori | A01D 34/902 224/259 |
| 9,089,188 | B2 * | 7/2015 | Wear | A45C 13/30 |
| 9,204,707 | B2 * | 12/2015 | Ito | A45F 3/14 |
| 10,230,077 | B2 * | 3/2019 | Rief | H01M 2/1005 |
| 2012/0110802 | A1 | 5/2012 | Zhao | |
| 2013/0160302 | A1 * | 6/2013 | Pellenc | A45F 3/14 30/275.4 |
| 2013/0277405 | A1 | 10/2013 | Jensen | |

FOREIGN PATENT DOCUMENTS

| | | | |
|---|---|---|---|
| EP | 2215920 | A2 | 8/2010 |
| EP | 2380427 | A1 | 10/2011 |

* cited by examiner

CARRY HARNESS WITH CHEST FASTENER

TECHNICAL FIELD

The present invention concerns a carry harness with chest fastener. A chest fastener is understood to be a carry harness for connecting on the chest two chest straps integral with the webbing of the carry harness so as to avoid the shoulder straps slipping towards the wearers arms.

The invention finds applications in the field of carrying battery-powered electric tools. In particular the harness of the invention can be provided for carrying a battery of accumulators on the back, and on the side, a power tool connected to the battery. The harness can also be used for carrying tools with thermal engines or even tools that are not motorized.

STATE OF PRIOR ART

The carry harness, just like many rucksacks/backpacks are equipped with carrying straps reaching over the wearers shoulders and possibly with a carrying belt in order to transfer a portion of the load to the wearer's hips.

Ease of carrying is improved by perfect fit of the harness to the wearers morphology. Therefore, the harness may be provided with various adjustment straps.

In particular, adjustment straps may be provided between the carrying shoulder straps so as to regulate a distance between the carrying shoulder straps on the chest. These are the chest straps. Such a strap is fastened to each carrying shoulder strap, During the carry, the straps are interconnected and extend horizontally on the wearer's chest.

The chest straps generally present a chest fastener so as to make them integral one with the other during the carry, or on the contrary, to release them from each other for putting the harness on or for taking it off.

In the particular case of harnesses for carrying tools, it is known to advantageously use the chest straps and the chest fastener which connects them in order to fasten at least one carrying strap. The carrying strap makes it possible to transfer a portion of the tool's weight to be carried to the chest fastener and across the chest fastener, to the front part of the shoulder straps extending on the wearer's torso. Another portion of the tool's weight can be transferred to the wearer's belt or back through a strap connected to a back portion of the harness.

Such a harness, dedicated to carrying a portable brush cutter, is known from the U.S. Pat. No. 8,925,774 document. But this harness does not allow adjusting a distance between the shoulder straps which is directly and exclusively fastened by the chest fastener. Furthermore, the various carrying or shoulder straps are connected in fixed manner to the chest fastener. In this manner dynamic stresses transmitted by a carrying strap are susceptible of causing twisting of the various straps. Finally, the chest fastener does not allow adding a supplementary carrying strap.

DISCLOSURE OF THE INVENTION

Great ease of carrying requires adequacy of the carrying harness with the wearer's morphology but also needs to take into account the nature of the load carried and its disposition relative to the wearer's body.

One difficulty exists in the case of a multi-purpose carrying harness, which is to say intended for carrying different types of tools or equipment.

An adjustment of the harness adapted to carrying a certain type of tool may turn out to be inappropriate for carrying a different type of tool.

The aim of the present invention is to propose a carrying harness that can be used for carrying on the back at least one battery, for carrying at least one tool or also for the combined carry of at least one tool and at least one battery.

Another aim of the invention is to propose such a harness with a chest fastener that can adapt itself automatically to different configurations of carry, with or without a transfer of a portion of the load carried on the chest straps.

Still another aim is to propose a harness where a load transferred to the chest straps can be automatically distributed over the carrying shoulder straps.

In order to achieve these aims the invention more specifically proposes a carrying harness including:

- two carrying shoulder straps,
- two chest straps connected to the carrying shoulder straps respectively,
- a chest fastener configured for a junction of the chest straps, the fastener extending along a fastener plane,
- at least one tool-carrying strap, and in which:
- the chest straps and the tool-carrying strap are connected to the chest fastener while being able to pivot freely in the fastener plane around at least one pivot axis passing through the chest fastener and perpendicular to the fastener plane,
- the chest fastener includes a first part and a second part, non-swiveling, provided with a lock to attach the two parts to each other and a one-hand operable release element to separate the two parts, the first part and the second part being connected to the chest straps respectively.

The first and second parts are considered to be non-pivoting when they are not free to pivot relative to each other, when they are fastened one to the other.

Preferably, each tool-carrying strap may be configured to be connected in a removable manner to the chest fastener so it can be detached when no tool is being carried.

The harness of the invention can thus be used in several configurations. It may be provided with a dorsal support plate for at least one battery of accumulators and serve to carry only the battery or batteries for the electric power supply for a tool. This is especially the case when using a small portable power tool, carried by hand, for example a pruning shear, a hedge trimmer or a chain saw.

The harness can also serve to carry at least one battery of accumulators and at least one tool. This is the case when using portable power tools of larger size such as a brush mower, a ground working tool or a blower, for example. Carrying these tools may also involve carrying additional tools such as a pruning shear, a chain saw or any other tool needed by the user for a combined job, Finally, the harness can serve to carry at least one tool, without a battery of accumulators. This is the case, example, when carrying a tool equipped with a thermal engine, such as a brush cutter, for example.

In the following description and unless specified otherwise, reference is made only to a single tool-carrying strap for carrying a tool on the wearer's side. It is however understood that the harness may have several tool-carrying straps and in particular two tool-carrying straps connected to the chest fastener. In the same manner, the carrying straps may be provided for carrying a tool or a load an the front.

On may furthermore notice that the chest straps may preferably be of the same length so that the chest fastener is essentially located in the middle of the chest. It can however be envisaged to give them different lengths so as to offset the chest fastener in the direction of one or the other of the straps for a different distribution of the load on the shoulder straps.

According to a preferred implementation of the chest fastener, the first and the second part of the fastener form respectively a first buckle and a second buckle. This way they make it possible to fasten the straps directly to the chest fastener.

An important characteristic of the invention is that the connection of the chest straps can freely swivel and, if applicable, so can the tool carrying strap, with the chest fastener. Thus the chest straps do not get twisted and do not get kinked when the chest fastener pivots or moves in reaction to dynamic stresses which can be applied to it especially through the tool-carrying strap.

The swivel of the straps relative to the chest fastener occurs in the fastener plane, around one or several pivot axes. When the harness is being worn, the fastener plane is essentially parallel to the wearer's chest.

Because of the free swivel, the chest straps and the tool-carrying strap can fowl between themselves variable angles so that each strap can automatically orientate itself in the direction of the forces it transmits.

By way of an illustration, when no tool-carrying strap is connected to the chest fastener or when no load is supported by the tool-carrying strap, the chest straps can occupy an essentially horizontal position when the harness is being worn. They are then essentially perpendicular to the carrying shoulder straps. They only support the forces necessary to avoid a gap between the carrying shoulder straps and form between themselves an angle of close to 180 degrees.

When a tool-carrying strap is connected to the chest fastener and the latter carries a load on one side of the wearer, the carrying strap and the chest straps pivot in order to occupy automatically a relative position essentially in a Y. In this position the relative angles between the various straps depend essentially on the size of the load.

This results, if applicable, in a balanced transfer of the weight carried on the shoulders of the wearer.

In the same manner, when two tool-carrying straps are connected to the chest fastener, for carrying a load on each side of a wearer, the straps automatically swivel to occupy a relative position essentially in an X.

As mentioned before, the chest fastener includes a first part and a second part, which are removable from each other and are linked respectively to the chest straps. The first and the second part can be fastened to each other by means of a lock of complementary shape, or they can be separated by releasing the lock. This characteristic in particular makes it possible to separate them to facilitate the installation or removal of the harness. When the first part and the second part are attached to each other, they do not swivel in relation to each other. By contrast, the straps connected to the chest fastener can swivel on the fastener and in particular on the first and second part of the fastener, depending on the supported loads.

When the first and the second part of the chest fastener form buckles for the fastening of straps, each buckle may include, respectively, a junction edge to the other buckle, and a connection edge opposite the junction edge. In that case each buckle is connected to a chest strap by its connection edge.

The tool-carrying strap can also be connected to one of the buckles of the chest fastener and specifically to its connection edge.

According to yet another possibility, the chest fastener may include at least one third buckle for the tool-carrying strap. In that case, the tool-carrying strap is connected to the third buckle of the chest fastener.

The third buckle may be mounted as a swivel on at least one of the first part and the second part of the chest fastener.

More generally still, the harness may include a first fastening, a second fastening and a third fastening for straps, connected respectively to the chest straps and to the tool-carrying strap, the first, second and third fastenings for straps being mounted as swivels on a chest fastener plate. The plate may be constituted by the first part, the second part or by the two parts of the chest fastener.

The swivel mounting of the fastenings on a plate of the chest fastener may take place on one or several pivots and along one or several pivot axes. In case of several pivots, the pivot axes are parallel to each other, since they are perpendicular to the fastening plane. The fastening plane corresponds in this case to that of the plate of the chest fastener. The fastenings for straps may be connected in removable fashion to the pivots of the chest fastener plate.

According to a simple and preferred implementation of the invention, fastening of the straps may take place by means of two fixed and non-swiveling buckles. This is the case when the first and the second part of the chest fastener form buckles. In this case, the connection edge of each buckle may present a form of semi-circle.

The two connection edges of the two buckles, in semi-circle, may preferably be centered on a same axis. It is then a pivot axis that is common to the chest straps and to the tool-carrying strap.

By using buckles in the shape of semi-circles, the swivel function of the straps can be performed by simply sliding the straps along the arched buckles.

In this case, the buckles present a useful length of strap fastening greater than a width of the chest straps and the tool-carrying strap, so as to provide a sufficient sliding track of the straps and ensure their pivoting in the direction of the loads.

Preferably, the buckles may be double buckles provided respectively with a fastening bar separating two slots of the buckle. In this case, each strap attached to the buckle passes through the two slots and while surrounding the fastening bar. The fastening bar may be shaped, in the manner known, to prevent an unintentional detachment of the straps and to maintain their tightness.

According to a particular implementation of the harness the chest fastener may include a release element actionable by one hand to separate the first part and the second part of the chest fastener and to release the harness very quickly in case of an incident or in case the wearer has an accident. In this way, the harness can be very quickly removed in case of an incident or in case the operator has an accident.

The harness may also include a tool support, the tool support being connected to the harness by the tool-carrying strap.

The tool support may furthermore be connected either to a lumbar belt of the harness, to a shoulder strap of the harness or to a dorsal plate of the harness. In this way, a tool such as a brush cutter, a blower or a cultivating tool, for example, can be fastened to the harness.

Other characteristics and advantages of the invention will become clear in the description below, with reference to the figures of the drawings.

This description is given for illustrative purposes and is not limiting

BRIEF DESCRIPTION OF THE FIGURES

FIG. 38 is a view of the chest fastener in a closed or "attached" configuration in which the chest fastener is connected to the two chest straps and two tool-carrying straps.

The figures are shown in free scale.

DETAILED DESCRIPTION OF THE MODES OF IMPLEMENTATION OF THE INVENTION

In the description below, identical or similar parts of the different figures are identified with the same reference marks so as to make it possible to refer from one figure to another.

Furthermore, the terms "high" and "low" are understood to mean relative to the vertical and relative to the way the harness is usually worn on the back of a wearer.

Figure 1:
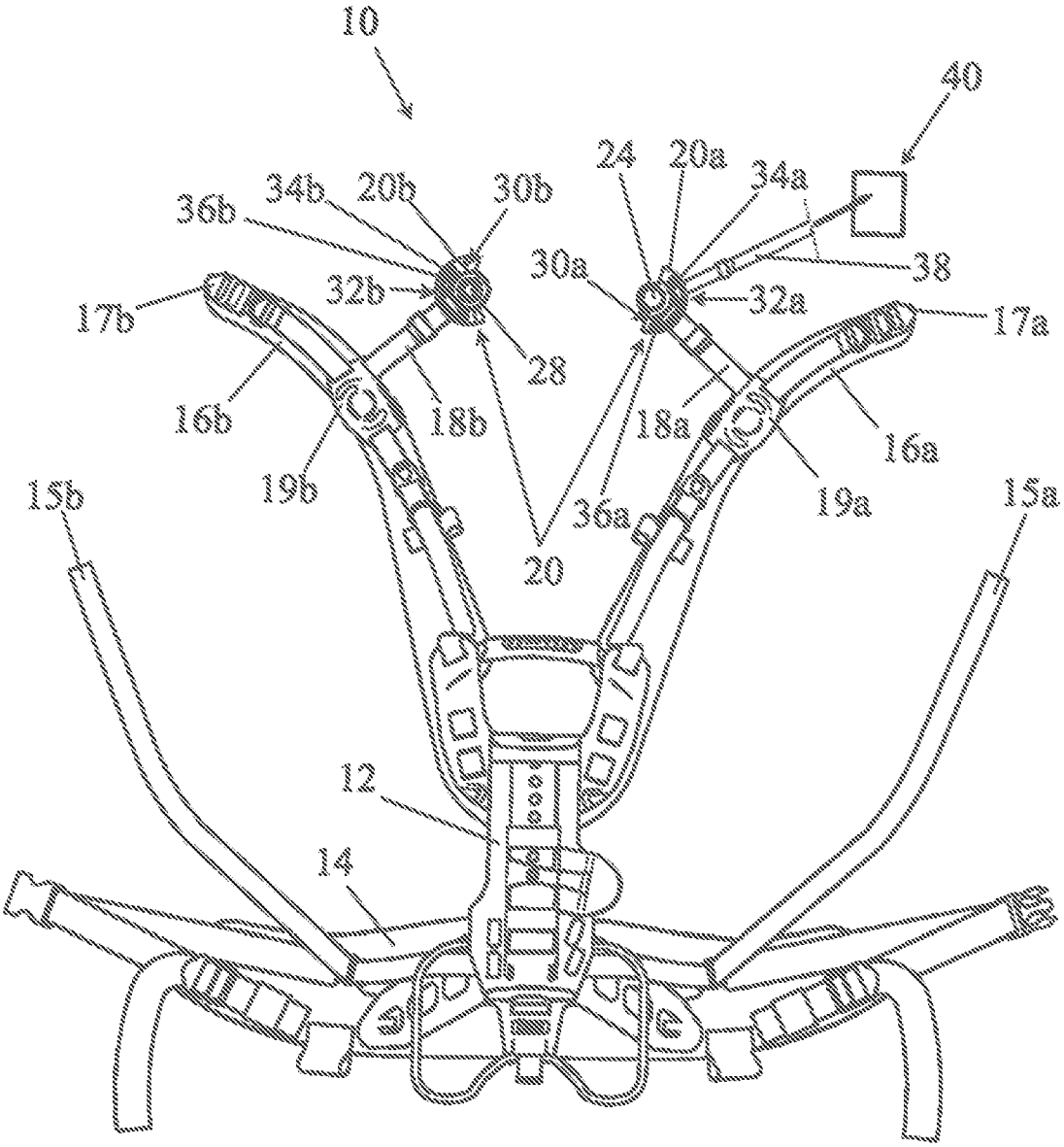
FIG. 1 is view of harness laid flat, according to the invention.

FIG. 1 shows a harness 10 according to the invention. It is shown lying flat. It includes a dorsal plate 12 for carrying a battery of accumulators, not shown. The dorsal plate is connected to a lumbar belt 14 and to carrying shoulder straps 16*a*, 16*b*.

When the harness is being worn, the carrying shoulder straps 16*a*, 16*b* extend from the dorsal plate 12 to the lumbar belt 14 by passing over the wearer's shoulders, More precisely, the ends 15*a*, 15*b* of a strap of shoulder straps in connection with the lumbar belt 14 are connected respectively to the ends 17*a*, 17*b* of the carrying shoulder straps 16*a*, 16*b*. The ends 17*a*, 17*b* of the carrying shoulder straps 16*a*, 16*b* are provided with fastening buckles receiving the ends 15*a*, 15*b* of the shoulder strap.

Figure 3A:
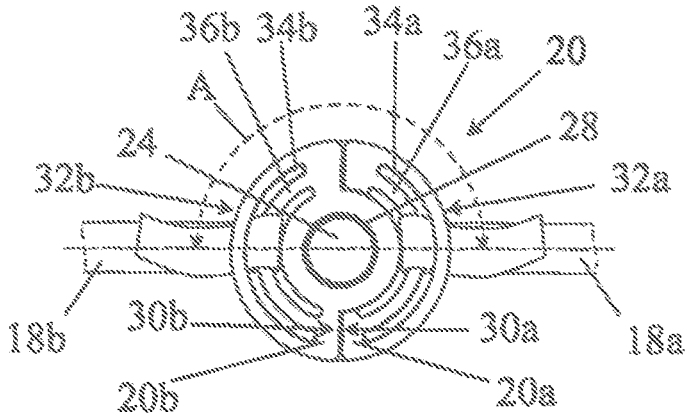
FIG. 3A is a view of the chest fastener in a closed or "attached" configuration in which the chest fastener is connected to the two chest straps.

In order to prevent the carrying shoulder strap from sliding, they are provided with chest straps 18*a*, 18*b* which extend on the wearer's torso to come together in a chest fastener 20. The chest fastener 20 is shown here in a detached configuration. For comparison, FIG. 3A shows the chest fastener in attached position. The chest straps are fastened to the shoulder straps by means of shoulder strap fasteners 19*a*, 19*b*. The chest straps extend in essentially perpendicular manner to the shoulder straps. However, the shoulder strap fasteners 19*a*, 19*b* may be provided to permit a swivel of the chest straps and a modification of the angle they form with the shoulder straps.

The chest fastener 20 presents two parts 20*a*, 20*b* equipped with a central lock 24, 28. The lock makes it possible to attach the two parts 20*a*, 20*b* one to the other along a junction edge 30*a*, 30*b* so as to obtain a junction of the chest straps.

The chest fastener 20 is made, for example, of a plastic material or of metal.

Figure 2:
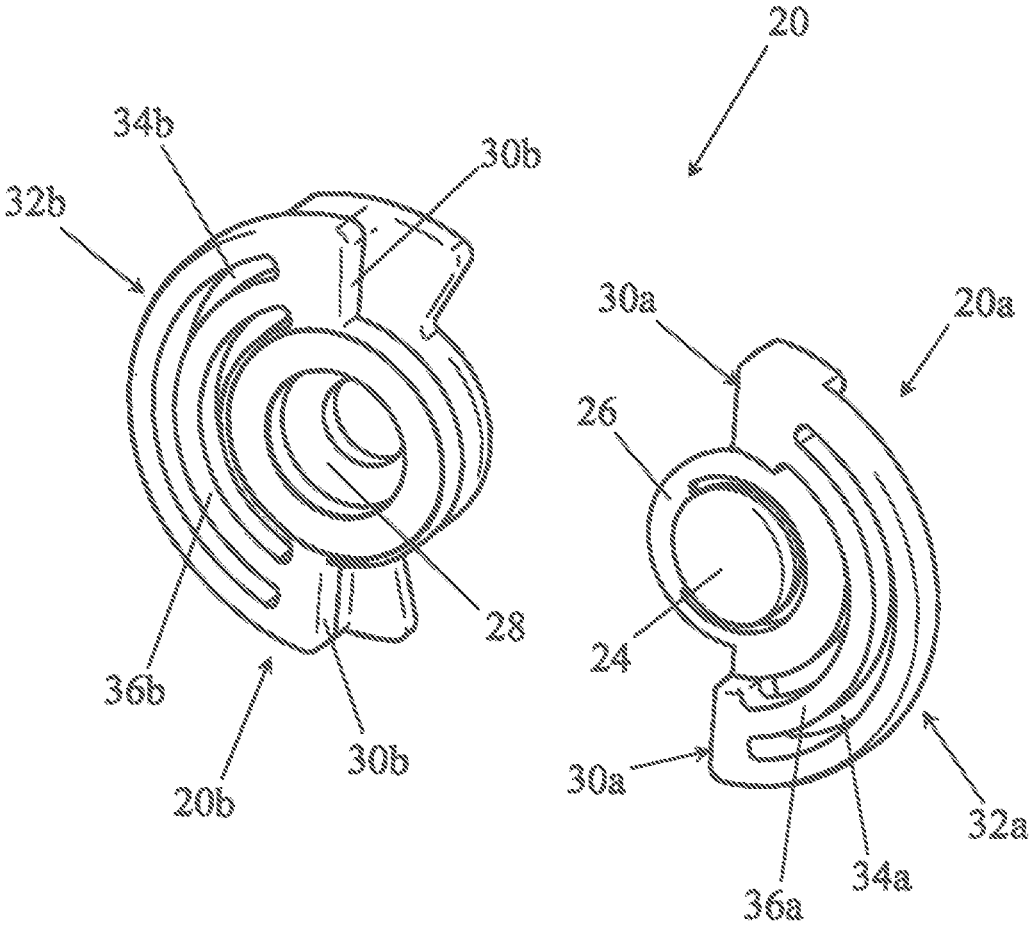
FIG. 2 is a perspective view of the chest fastener of the harness in an open or "detached" configuration in which the straps are not shown.

As is better shown on FIG. 2 on which the two parts of the chest fastener are also separated, one of the parts 20*a* presents a cylindrical button 24 mounted on a flexible blade 26. The central button is seated in a corresponding central cylindrical housing 28 on the other part 20*b* of the chest fastener when the two parts 20*a*, 20*b* are brought close together so as to put into contact their respective junction edges 30*a*, 30*b*. The junction edges 30*a*, 30*b* extend in essentially vertical manner when the harness is worn.

The central button 24 constitutes with the central housing 28 a lock. The central button also constitutes a releasing element of the lock for one-hand operation. In effect, by pressure of one finger on the central button 24 it can be retracted from the central housing 28 through flexion of the flexible blade 26. This retraction of the central button enables the separation of the two parties 20*a*, 20*b* from the chest fastener 20.

Each part 20*a*, 20*b* of the chest fastener 20 presents a connection edge 32*a*, 32*b*, opposite the junction edge 30*a*, 30*b* and extending respectively from a high part of the edge of junction 30*a*, 30*b* towards a low part of the edge of junction 30*a*, 30*b*. Each part 20*a*, 20*b* and in particular its connection edge 32*a*, 32*b*, constitutes a buckle 34*a*, 34*b* for the connection of the straps. By extension, each part 20*a*, 20*b* of the chest fastener 20 of FIG. 1 is considered to be a "buckle".

The connection edges 32*a*, 32*b* and thus the buckles 34*a*, 34*b* present a semi-circle shape centered in the middle of the central button 24 and of the central housing 28. Each buckle 34*a*, 34*b* presents furthermore a fastening bar 36*a*, 36*b*, also in semi-circle which separates two slots of the buckle.

Figure 3B:
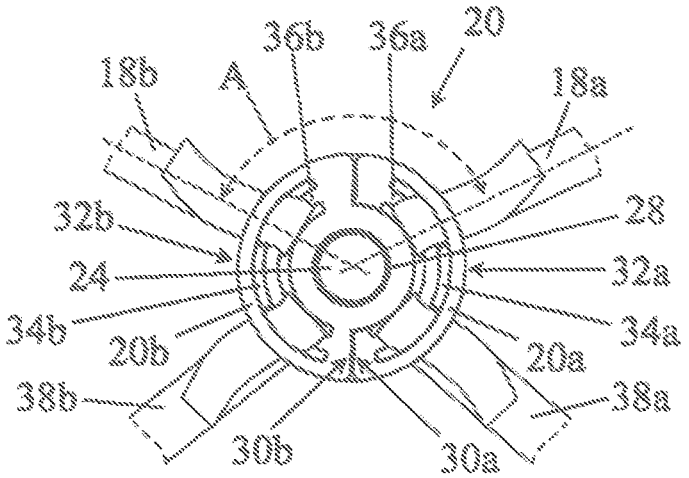
FIG. 3C is a view of another implementation of the chest fastener in a closed or "attached" configuration in which the chest fastener is connected to the chest straps and a tool-carrying strap.

As FIGS. 1 and 3B show, the chest straps 18*a*, 18*b* pass into the slots of the buckles, around fastening bars 36*a*, 36*b* so that each buckle 34*a*, 34*b* constitutes a strap fastening.

The harness of FIG. 1 also includes a tool-carrying strap 38 to which a tool support 40, indicated symbolically, can be attached. Just like the chest straps 18*a*, 18*b*, the tool-carrying strap 38 is fastened to the chest fastener. In the example of FIG. 1, the tool-carrying strap 38 is connected to the buckle 34*a* of one of the parts 20*a* of the chest fasteners 20. It should be noted that another end, not shown, of the tool-carrying strap 38 may be connected to the lumbar belt 14 or to the dorsal plate 12.

As shown on FIGS. 1 and 3A, the buckles 34*a*, 34*b* present a useful length for strap fastening considerably greater than the width of the straps and even than the cumulative length of the chest straps and the tool-carrying strap.

The various straps can thus slide along the buckles 34*a*, 34*b* in a semi-circle. Being able to slide from their fastening point along the arched buckles gives the straps a freedom to swivel in a plane passing through the buckles 34*a*, 34*b* and designated by "fastening plane". In the example of FIGS. 1 and 3A, the pivoting can take place around a single pivot axis, perpendicular to the fastening plane and passing through the center of the central button 24 or of the central housing 28. These two axes merge when the two parts 20*a*, 20*b* of the chest fastener 20 are attached to each other. In effect, the curvature of the buckles 34*a*, 34*b* is also centered on this axis.

When no tool-carrying strap is attached to the chest fastener 20, or when no tool is attached to the tool-carrying strap 38, the angle A between the chest straps 18*a*, 18*b* is close to 180 degrees as shown on FIG. 3A.

Inversely, if at least one tool, or more generally a heavy load is attached to a tool-carrying strap 38, 38*a*, 38*b*, the angle A becomes less than 180 degrees by pivoting of the straps around the pivot axis. This configuration is shown in FIGS. 38 and 3C.

Figure 3C:
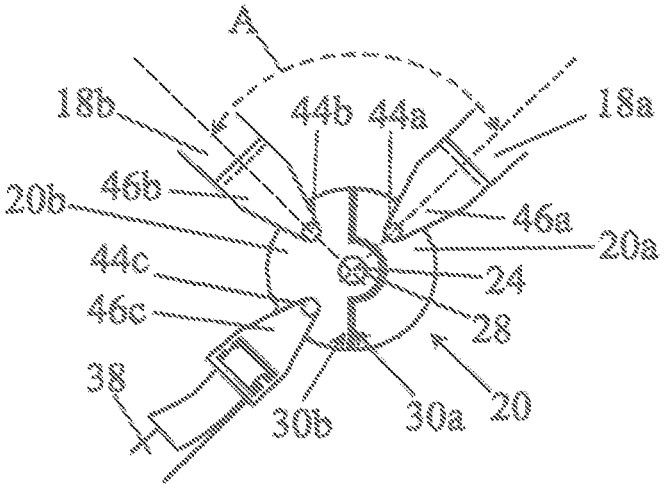

FIG. 38 shows an example of utilization of the chest fastener 20 with two tool straps 38*a*, 38*b* in a configuration of the straps essentially in an X, FIG. 3C shows another possible implementation of the chest fastener 20 and another possibility of fastening the straps on it.

In the example of FIG. 3C, the chest fastener 20 presents itself in the form of a plate in two parts 20*a*, 20*b*, capable of being locked one on the other by means of a lock 24, 28, comparable to that of FIGS. 1 and 2. The plate of the chest fastener presents three pivots 44*a*, 44*b* and 44*c* fitted along three pivot axes parallel to each other and perpendicular to the fastener plane, which is to say here perpendicular to the chest fastener plate and perpendicular to the plane of FIG. 3*c*.

The first swivel 44*a* is integral with one of the parts 20*a* of the chest fastener, whereas the second and the third swivel 44*b*, 44*c* are integral with the other part 20*b* of the chest fastener 20.

Two fastenings for strap 46*a*, 46*b* integral respectively with the chest straps 18*a*, 18*b* are mounted as swivels respectively on the first swivel and the second swivel 44*a*, 44*b*.

A third fastening for straps, in the form of a third buckle 46*c* is mounted as a swivel on the third swivel 44*c*. The third buckle is provided for the removable fastening of the tool-carrying strap 38.

The chest fastener of FIG. 3C like that of the preceding figures, enables the straps to swivel freely in the fastener plane, but along three distinct pivot axes.

According to one variant, the first and the second fastening 46*a* and 46*b* may also present themselves in the form of buckles for the fastening of the chest straps.

According to another variant two of the fastenings 46, 46*b*, 46*c*, or even all three may be mounted as swivels on a same pivot of the chest fastener.

The invention claimed is:

1. A carrying harness comprising:

a dorsal plate;

a lumbar belt;

a pair of carrying shoulder straps each extending from said dorsal plate to said lumbar belt;

a pair of chest straps connected respectively to said pair of carrying shoulder straps;

a chest fastener configured for a junction of said pair of chest straps, said chest fastener extending along a fastener plane; and at least one tool-carrying strap distinct from said pair of carrying shoulder straps, wherein said pair of chest straps and said at least one tool-carrying strap are connected to said chest fastener and are free to pivot in the fastener plane around at least one pivot axis that passes through said chest fastener and is perpendicular to the fastener plane, wherein said chest fastener has a first part and second part that are non-swiveling, the first part and the second part being lockable to each other, said chest fastener having a release element that is cooperative with the first part and the second part such that the first part and the second part are releasable from each other, wherein the first part and the second part are respectively connected to said pair of chest straps.

2. The carrying harness of claim 1, wherein the first part is a first buckle and a second part is a second buckle.

3. The carrying harness of claim 2, wherein each of the first buckle and the second buckle has a junction edge and a connection edge opposite to the junction edge, each of the first buckle and the second buckle being respectively connected to said pair of chest straps by the connection edge thereof.

4. The carrying harness of claim 2, wherein said at least one tool-carrying strap is connected to one of the first buckle and the second buckle.

5. The carrying harness of claim 3, where in the connection edge has a semi-circular shape, each of the first buckle and the second buckle having a length greater than a width of one of said pair of chest straps and greater than a width of said at least one tool-carrying strap.

6. The carrying harness of claim 2, wherein each of the first buckle and the second buckle has a fastening bar that separates a pair of buckle slots.

7. The carrying harness of claim 2, wherein said chest fastener has a third buckle, said at least one tool-carrying strap being connected to the third buckle, the third buckle being mounted by a swivel on at least one of the first part and the second part of said chest fastener.

* * * * *